US006604696B1

(12) United States Patent
McGuire

(10) Patent No.: US 6,604,696 B1
(45) Date of Patent: Aug. 12, 2003

(54) ULTRA-HIGH PRESSURE WATER JET RING WITH ANGLED NOZZLES AND A CONICAL DISPERSION PATTERN

(76) Inventor: Dennis McGuire, 3231 SE. St. Lucie Blvd., Stuart, FL (US) 34957

( * ) Notice: Subject to any disclaimer, the term of this patent is extended or adjusted under 35 U.S.C. 154(b) by 0 days.

(21) Appl. No.: 10/157,668

(22) Filed: May 29, 2002

(51) Int. Cl.[7] ..... F23D 14/48

(52) U.S. Cl. ..... 239/548; 239/567; 239/589; 239/565

(58) Field of Search ..... 239/532, 548, 239/567, 590.5, 589, 565, 558, 559, 222.11, 222.13; 222/174

(56) References Cited

U.S. PATENT DOCUMENTS

| | | | | |
|---|---|---|---|---|
| 4,313,570 A | * | 2/1982 | Olsen | 239/583 |
| 5,485,961 A | | 1/1996 | Reitzig | 239/558 |
| 5,628,271 A | | 5/1997 | McGuire | 114/222 |
| 5,849,099 A | | 12/1998 | McGuire | 134/10 |
| 6,142,388 A | * | 11/2000 | Schwab | 239/405 |
| 6,161,769 A | * | 12/2000 | Kircher et al. | 239/2.2 |

* cited by examiner

*Primary Examiner*—Gregory L. Huson
*Assistant Examiner*—Amanda Flynn
(74) *Attorney, Agent, or Firm*—McHale & Slavin, P.A.

(57) ABSTRACT

A light weight carrier head is attached to a hand held wand for fluid removal of coatings, paint and other accretions from structural surfaces. The carrier head is in the shape of a ring with equidistant nozzles capable of producing 25,000 to 60,000 psi fluid dispersions covering a swath of up to 6 inches.

10 Claims, 1 Drawing Sheet

ULTRA-HIGH PRESSURE WATER JET RING WITH ANGLED NOZZLES AND A CONICAL DISPERSION PATTERN

FIELD OF THE INVENTION

This invention relates to the field of high pressure cleaning tools for removing coatings, paint and other accretions from surfaces of bridges, roadways, sidewalks, water tanks and other storage containers, buildings, ships, and other vehicles. Specifically, the invention concerns a hand held tool for applying fluid dispersions to steel, aluminum, concrete or other structural materials.

BACKGROUND OF THE INVENTION

In the disclosures of U.S. Pat. No. 5,628,271 and U.S. Pat. No. 5,849,099, there is an explanation of the economic effects of a fouled bottom upon the operations of large ships. These economic factors are still true and illustrate the importance of this invention which teaches a quick and cost effective way to remove the performance robbing accretions.

Further, proper maintenance of a ship, both below and above the waterline, greatly extends the life span of a ship. The marine environment is very harsh on any exposed metal, causing rust and corrosion, making it very important to maintain a continuous, non-interrupted, protective coating on all surfaces. This requires constant attention to the condition of the paints or other coverings applied to the entirety of the ship. Once rust or corrosion penetrates a painted surface, it is necessary to remove the paint to expose the surrounding area and remove the rust and/or corrosion from the smaller affected area, then recover the whole area. This invention teaches a way to quickly expose large areas for refurbishing.

The large relatively unobstructed flat areas of ships may be cleaned using robots or other mechanized devices thereby significantly reducing the required man hours. There are many smaller complex surfaces that conventional robots may not effectively clean. In these labor intensive areas, hand held wands must be used for complete removal of the necessary coverings.

The above referenced patents also discuss the environmental effects of the different conventional methods used to remove large amounts of accretions and protective coatings from the ships or other structures. The conventional methods include dry abrasion using sand or coal slag particles in high pressure air streams and wet abrasion using different particles in a liquid stream. All of these systems leave large amounts of contaminated by-products released into the atmosphere and for disposal.

The disclosures of the above referenced patents include the use of large amounts of high pressure water impinging on the hull within an enclosed space for removing the coatings on the hulls of ships to include paints, coatings and organisms. A slurry of waste materials and water remains for disposal. The environmental impact of this method is significantly less than the other conventional methods. The same environmental considerations are true in the use of the hand held wands.

The conventional hand held wands are heavy and cumbersome which greatly reduces the operator's ability to manipulate them without frequent rest periods. In all applications, the time to remove the given coatings is critical and controls the cost of each project. Since the operator has to hold the wand out in front of him all day, the weight of the carrier head is most important, as well as, the size of the cleaning path. Present designs have been limited to a path of two to three inches because of the weight of the wand. Anything larger causes premature fatigue to the operator.

DESCRIPTION OF THE PRIOR ART

U.S. Pat. No. 5,485,961 to Reitzig discloses a nozzle head for a hand held jet cleaning device. The nozzle head is a solid conical shape with angled bores from a central supply input tapering outwardly to multiple nozzles. The nozzle head is to be connected to a hand held lance or wand and manipulated by an operator.

The nozzle head appears to be monolithic with difficult to machine angled bores in a truncated cone.

What is needed in the art is a light weight carrier head that is easy to operate for long periods of time and covers a wide path on each pass providing increased efficiency.

SUMMARY OF THE INVENTION

A light weight carrier head is attached to a hand held wand for fluid removal of coatings, paint and other accretions from structural surfaces. The carrier head is in the shape of a ring with equidistant nozzles capable of producing 25,000 to 60,000 psi fluid dispersions covering a swath of up to 6 inches. The cleaning tool has a central axis with a fluid supply connection, a plurality of spokes radiating outwardly from said central axis and terminating in a ring connecting said spokes with each of the spokes containing a bore. One end of each of bore communicates with the central axis. The other end of each of bore terminates in nozzles mounted in the ring. The nozzles are capable of 25,000 to 60,000 psi fluid pressure.

Accordingly, it is an objective of the instant invention to teach an apparatus and method of removing coatings, including animal and plant organisms, paint, or other materials, from structural surfaces by a manual process using a hand held wand with a light weight carrier head.

It is a further objective of the instant invention to teach a carrier head with a central supply conduit and multiple lines disposed in a common plane terminating in ultra high pressure nozzles.

It is yet another objective of the instant invention to teach a carrier head having an outer ring periphery connected to a central supply conduit by spokes containing lines transmitting fluid to nozzles in the ring.

It is a still further objective of the invention to teach the angular orientation of the nozzles with regard to the supply lines of the carrier head.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DESCRIPTION OF THE INVENTION

Figure 1:
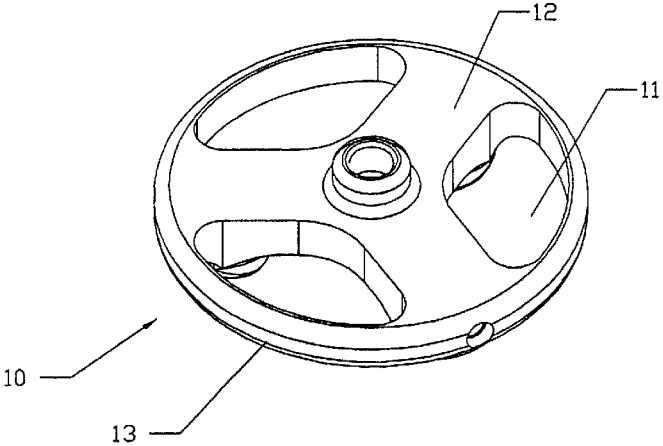
FIG. 1 is a plan view of the carrier head of this invention.

The carrier head 10 may be fabricated from strong light weight materials, such as alloyed steel, aluminum, and titanium, or the like. The light weight of the carrier head 10 also results from of the elimination of large portions of material not necessary to the strength or operation of the cleaning device. These spaces 11 are bordered by the spokes 12 and the segments of the ring 13. This ring structure may result in a 14 to 1 savings in weight.

For example, a carrier head such as shown by Reitzig, mentioned above, fabricated to cut a swath of 6 inches per pass would have to be about 7 inches wide and 9 inches long. If made from titanium, the head would weigh somewhere between 28 and 40 pounds. Such a head placed on the end of a 5 or 6 feet long lance or wand would require the operator to expend large amounts of foot-pounds of energy to move the device. The carrier head 10, fabricated to provide a clean swath of 6 inches per pass, would weigh about 2 pounds.

Figure 3:
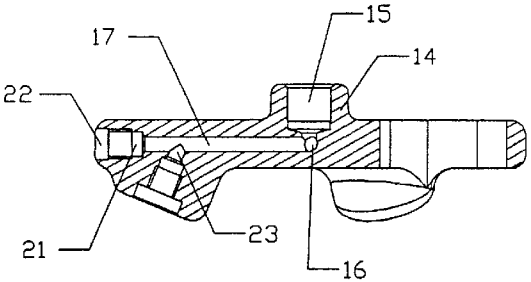
FIG. 3 is a cross section of the carrier head on line A—A of FIG. 2.
Figure 2:
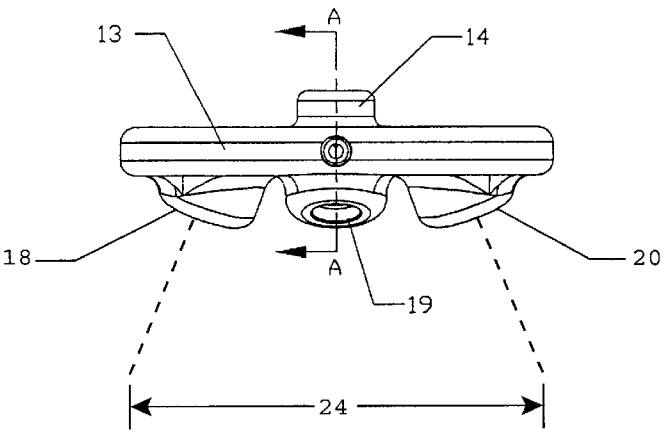
FIG. 2 is a side view of the carrier head of this invention.

The carrier head has a central axis containing a connector 14 for communicating with the fluid supply carried by the wand (not shown). As shown in FIG. 3, the connector has a supply conduit 15 ending in a blind bore 16. The blind bore 16 has several apertures about its circumference communicating with the bores 17. Each spoke 12 has a bore 17 which carries the fluid from the supply conduit 15 to the nozzles 18, 19 and 20, shown in FIG. 2.

The ring 13 is planar and the spokes 12 lay in the same plane. This organization permits a simple production of the bores 17 parallel to the surfaces of the spokes 12 and normal to the blind bore 16. In the embodiment shown in FIG.3, the bores 17 extend from the exterior of the ring 13 through the spoke to the blind bore 16. The external opening 21 of the bore 17 is closed by a plug 22.

The nozzles 18, 19, and 20 are located at the periphery of the ring 13. Each nozzle is mounted at an angle to the plane of the spokes 12 and connected to the bores 17 by short angled passages 23. The particular angle is set to provide the width of the cleaning swath 24, as well as, the dynamic action of the fluid upon the structural member being cleaned. In the preferred embodiment the cleaning swath 24 is at least about three inches in diameter. Different carrier heads may have different nozzle angles for different purposes. The ultra high pressure fluid ejected from the nozzles may be in the range of 25,000 to 60,000 psi and sufficient to clean different types of structural surfaces. The light weight carrier head can increase the production rate by doubling the cleaned path and by producing less fatigue in the operator.

The manufacturing of the carrier head is simplified in that all bores are machined perpendicular to each other. The angled drilling or machining is of minimal distance and directed along the plane of elongated bores thereby reducing the criticality of the interception angle. The carrier head may be made by casting or forging with subsequent drilling or machining. Or the carrier head may be made as components and assembled into an integral device.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

What is claimed is:

1. A light weight carrier head for an ultra high pressure cleaning tool comprising a central axis having a fluid supply connection, a plurality of spokes radiating outwardly from said central axis and terminating in a ring connecting said spokes, each of said spokes containing a bore, one end of each of said bores communicating with said central axis, the other ends of each of said bores terminating in nozzles mounted in said ring, said nozzles capable of 25,000 to 60,000 psi fluid pressure.

2. A light weight carrier head of claim 1 wherein said nozzles are angularly disposed in relation to the diameter of said ring resulting in a dispersion of the fluid away from said ring.

3. A light weight carrier head of claim 2 wherein said dispersion defines a diameter of about three inches.

4. A light weight carrier head of claim 2 wherein said dispersion is conical in shape.

5. A light weight carrier head of claim 4 wherein said angularly disposed nozzles are arranged within said ring to disperse said fluid in a converging conical pattern in relation to said ring.

6. A light weight carrier head of claim 4 wherein said angularly disposed nozzles are arranged to disperse said fluid in a diverging conical pattern in relation to said ring.

7. A light weight carrier head of claim 4 wherein at least one of said angularly disposed nozzles is arranged to disperse said fluid in a diverging conical pattern in relation to said ring and at least one of said angularly disposed nozzles is arranged to disperse said fluid in a converging conical pattern in relation to said ring.

8. A light weight carrier head in the form of a generally circular support frame having a central axis adapted to be connected to a hand held wand for applying ultra high pressure fluid to a surface to remove any one of the group consisting of surface coatings, paint, or accretions, from a structural surface comprising a connector adapted to secure said carrier head to a wand, said connector including an ultra high pressure fluid supply conduit, a plurality of ultra high pressure fluid supply bores formed integrally within said generally circular support frame and perpendicular to said central axis each said ultra high pressure fluid supply bore connected at one end to said fluid supply conduit and connected at a second end to at least one nozzles, each said nozzles capable of dispersing fluid from about 25,000 to about 60,000 psi.

9. A light weight carrier head of claim 6 wherein said nozzles are located equidistant about said generally circular support frame.

10. A light weight carrier head of claim 8 wherein said plurality of bores are disposed in a common plane and said nozzles disperse fluid at an angle to said plane.

* * * * *